US010273877B2

(12) United States Patent
Zahdeh

(10) Patent No.: US 10,273,877 B2
(45) Date of Patent: Apr. 30, 2019

(54) VARIABLE COMPRESSION RATIO ENGINE

(71) Applicant: GM GLOBAL TECHNOLOGY OPERATIONS LLC, Detroit, MI (US)

(72) Inventor: Akram R. Zahdeh, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 79 days.

(21) Appl. No.: 15/364,426

(22) Filed: Nov. 30, 2016

(65) Prior Publication Data

US 2017/0284290 A1 Oct. 5, 2017

Related U.S. Application Data

(60) Provisional application No. 62/314,571, filed on Mar. 29, 2016.

(51) Int. Cl.
*F02B 23/08* (2006.01)
*F02B 75/04* (2006.01)

(52) U.S. Cl.
CPC ..... *F02B 75/042* (2013.01)

(58) Field of Classification Search
CPC combination set(s) only.
See application file for complete search history.

(56) References Cited

U.S. PATENT DOCUMENTS 5,878,701 A * 3/1999 Kahlhamer ..... F02B 75/042 123/48 A
6,578,533 B1 * 6/2003 Gray, Jr. ..... F02B 1/12 123/48 D
9,239,003 B1 * 1/2016 Manke ..... F02B 75/042
2002/0104492 A1 * 8/2002 Cowans ..... F02B 25/18 123/48 R
2007/0256658 A1 * 11/2007 Andersson ..... F01B 31/14 123/193.5

* cited by examiner

*Primary Examiner* — Lindsay Low
*Assistant Examiner* — Ruben Picon-Feliciano
(74) *Attorney, Agent, or Firm* — Quinn IP Law

(57) ABSTRACT

A variable compression ratio (VCR) internal combustion engine includes an engine block defining a cylinder and a cylinder head mounted to the engine block and defining at least a part of a combustion chamber. The engine also includes a reciprocating primary piston arranged inside the cylinder and configured to compress a mixture of air and fuel and a crankshaft arranged in the engine block and rotated by an application of a combustion force to the primary piston. The engine additionally includes a secondary piston mounted in the cylinder head, movably with respect to the combustion chamber and a mechanism configured to shift the secondary piston in the cylinder head and thereby vary a volume of the combustion chamber and a compression ratio of the engine. A vehicle employing such an engine is also disclosed.

13 Claims, 5 Drawing Sheets

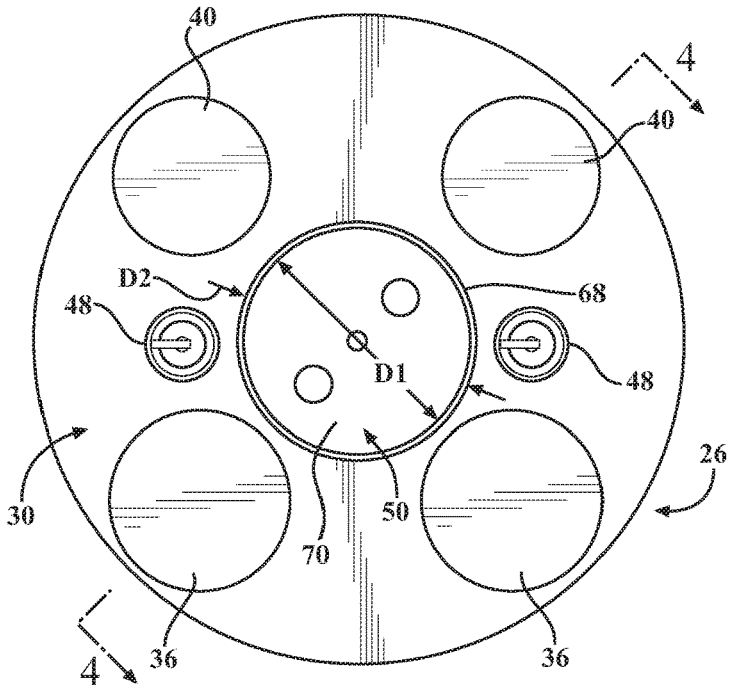
FIG. 3
FIG. 4
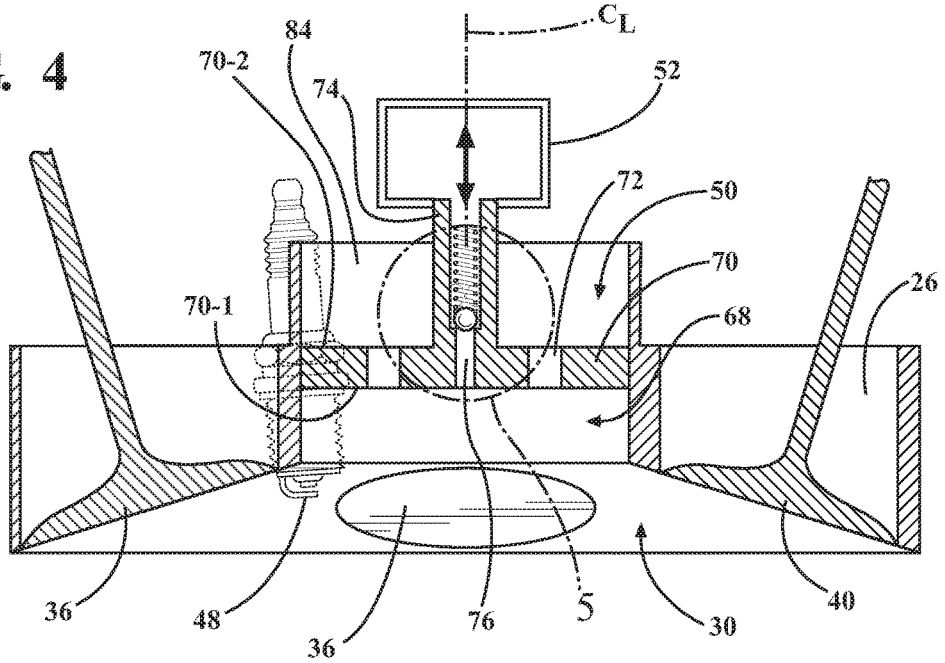

VARIABLE COMPRESSION RATIO ENGINE

CROSS-REFERENCE TO RELATED APPLICATION(S)

This application claims the benefit of U.S. Provisional Application Ser. No. 62/314,571 filed Mar. 29, 2016, the entire content of which is hereby incorporated by reference.

TECHNICAL FIELD

The present disclosure relates to an internal combustion engine with a variable compression ratio.

BACKGROUND

An internal combustion engine is a heat engine in which the combustion of a fuel occurs with an oxidizer (typically air) in a combustion chamber that is an integral part of the engine. Internal combustion engines are often employed for powering vehicles, either as a primary power source, or as part of a hybrid powertrain. In a reciprocating internal combustion engine, expansion of the high-temperature and high-pressure gases in a combustion chamber space at the top of the cylinder produced by the combustion applies direct force to the engine's piston. The combustion force applied to the piston subsequently acts through the engine's connecting rod to turn the engine's crankshaft.

A compression ratio is one of the fundamental specifications of an internal combustion engine. An internal combustion engine's compression ratio is a value that represents the ratio of the volume of the engine's combustion chamber from its largest capacity to its smallest capacity. In a reciprocating internal combustion engine the compression ratio is typically defined as the ratio between the volume of the cylinder and combustion chamber when the piston is at the bottom of its stroke, and the volume of the combustion chamber when the piston is at the top of its stroke. An internal combustion engine's compression ratio greatly influences the subject engine's torque output and its fuel efficiency.

SUMMARY

One embodiment of the disclosure is directed to a variable compression ratio (VCR) internal combustion engine that includes an engine block defining a cylinder and a cylinder head mounted to the engine block and defining at least a part of a combustion chamber. The engine also includes a reciprocating primary piston arranged inside the cylinder and configured to compress a mixture of air and fuel and a crankshaft arranged in the engine block and rotated by an application of a combustion force to the primary piston. The engine additionally includes a secondary piston mounted in the cylinder head, movably with respect to the combustion chamber and a mechanism configured to shift the secondary piston in the cylinder head and thereby vary a volume of the combustion chamber and a compression ratio of the engine.

The cylinder has a cylinder centerline and the mechanism can be configured to generate a linear motion of the secondary piston along the cylinder centerline.

The mechanism can include an electro-mechanical actuator having a stepper motor operatively connected to a worm wheel in mesh with a worm screw.

The engine can also include a fluid pump configured to pressurize engine oil. In such case, the mechanism can include a hydraulic actuator driven by the oil pressurized by the fluid pump.

The engine can additionally include a vacuum pump. In such case, the mechanism can include a pneumatic actuator driven by the vacuum pump.

The cylinder head can define a cavity and the secondary piston can be configured to shift inside the cavity. Accordingly, the secondary piston can be configured to vary the compression ratio of the engine by selectively expanding and contracting the size of the cavity.

The secondary piston can include a secondary piston body having a first surface facing the primary piston, an opposing second surface, and a secondary piston shaft fixed to the second surface of the secondary piston body. The secondary piston shaft can be operatively connected to the mechanism.

The secondary piston can define a gas passage extending from the first surface of the secondary piston body into the shaft. Additionally, the gas passage can be in fluid communication with a blow-off orifice. The secondary piston shaft can include a check-valve arranged inside the gas passage such that the check-valve is configured to relieve pressure from inside the combustion chamber into the blow-off orifice above a predetermined combustion pressure value.

The secondary piston body can define a vent orifice configured to provide pressure equalization between the first surface and the second surface of the secondary piston body.

The engine can also include a plurality of spark plugs arranged inside the combustion chamber and configured to ignite the mixture of air and fuel for initiating combustion thereof.

The engine can operate according to the Miller cycle, and can be either a spark-ignition or a compression-ignition type.

Another embodiment of the present disclosure is directed to a vehicle employing such a VCR internal combustion engine.

The above features and advantages, and other features and advantages of the present disclosure, will be readily apparent from the following detailed description of the embodiment(s) and best mode(s) for carrying out the described disclosure when taken in connection with the accompanying drawings and appended claims.

BRIEF DESCRIPTION OF THE DRAWINGS

FIG. 3 is a schematic top view of the combustion chamber with the secondary piston shown in FIG. 2.

FIG. 4 is a schematic cross-sectional illustration of the combustion chamber with the secondary piston shown in FIG. 2.

DETAILED DESCRIPTION

Figure 1:
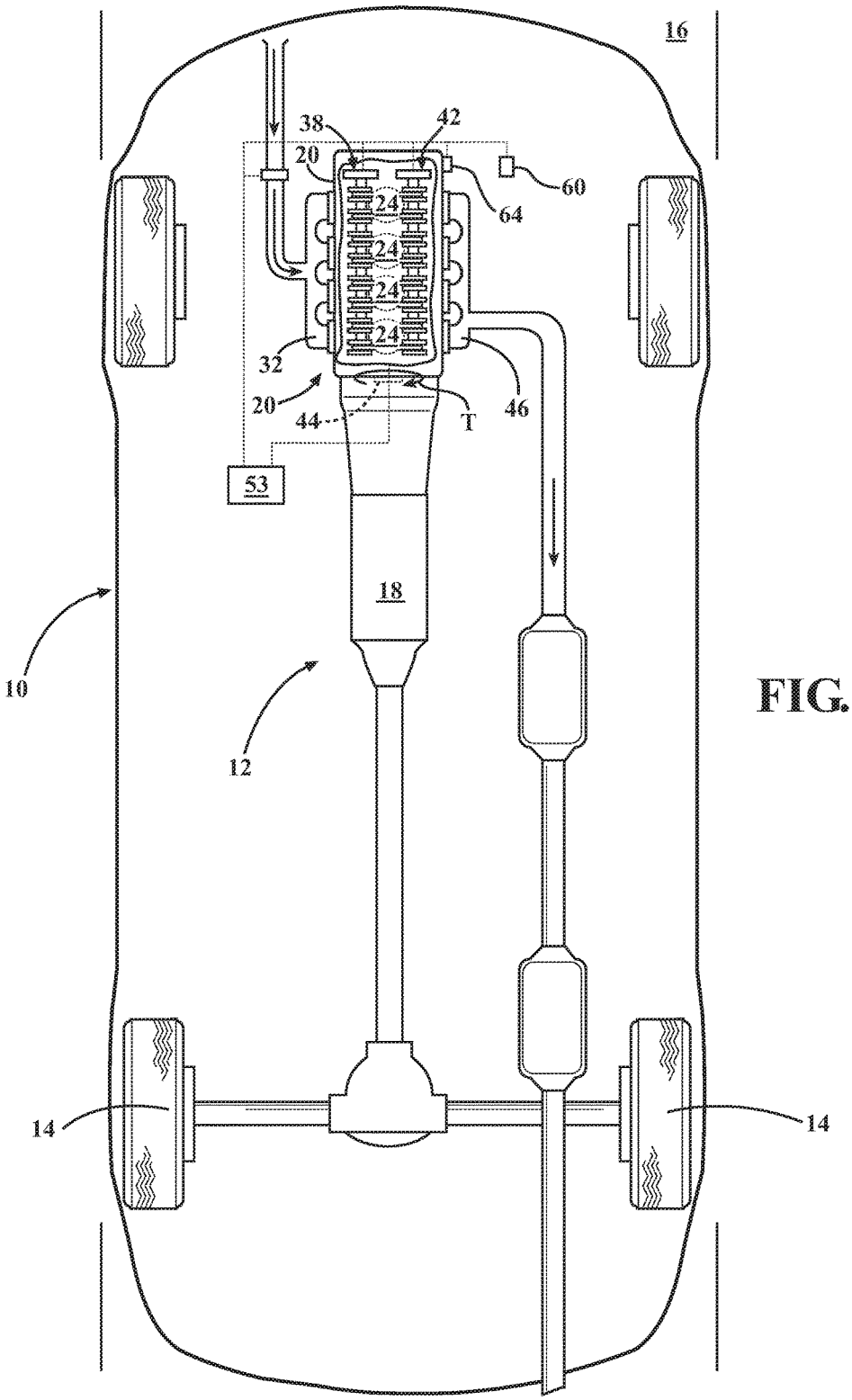
FIG. 1 is a schematic depiction of a vehicle having a variable compression ratio (VCR) engine according to the disclosure.

Referring to the drawings, wherein like reference numbers correspond to like or similar components throughout the several figures, FIG. 1 illustrates a vehicle 10 employing a powertrain 12 for propulsion thereof via driven wheels 14 relative to a road surface 16. The vehicle 10 may include, but not be limited to, a commercial vehicle, industrial vehicle, passenger vehicle, aircraft, watercraft, train or the like. It is also contemplated that the vehicle 10 may be any mobile platform, such as an airplane, all-terrain vehicle (ATV), boat, personal movement apparatus, robot and the like to accomplish the purposes of this disclosure.

Figure 2:
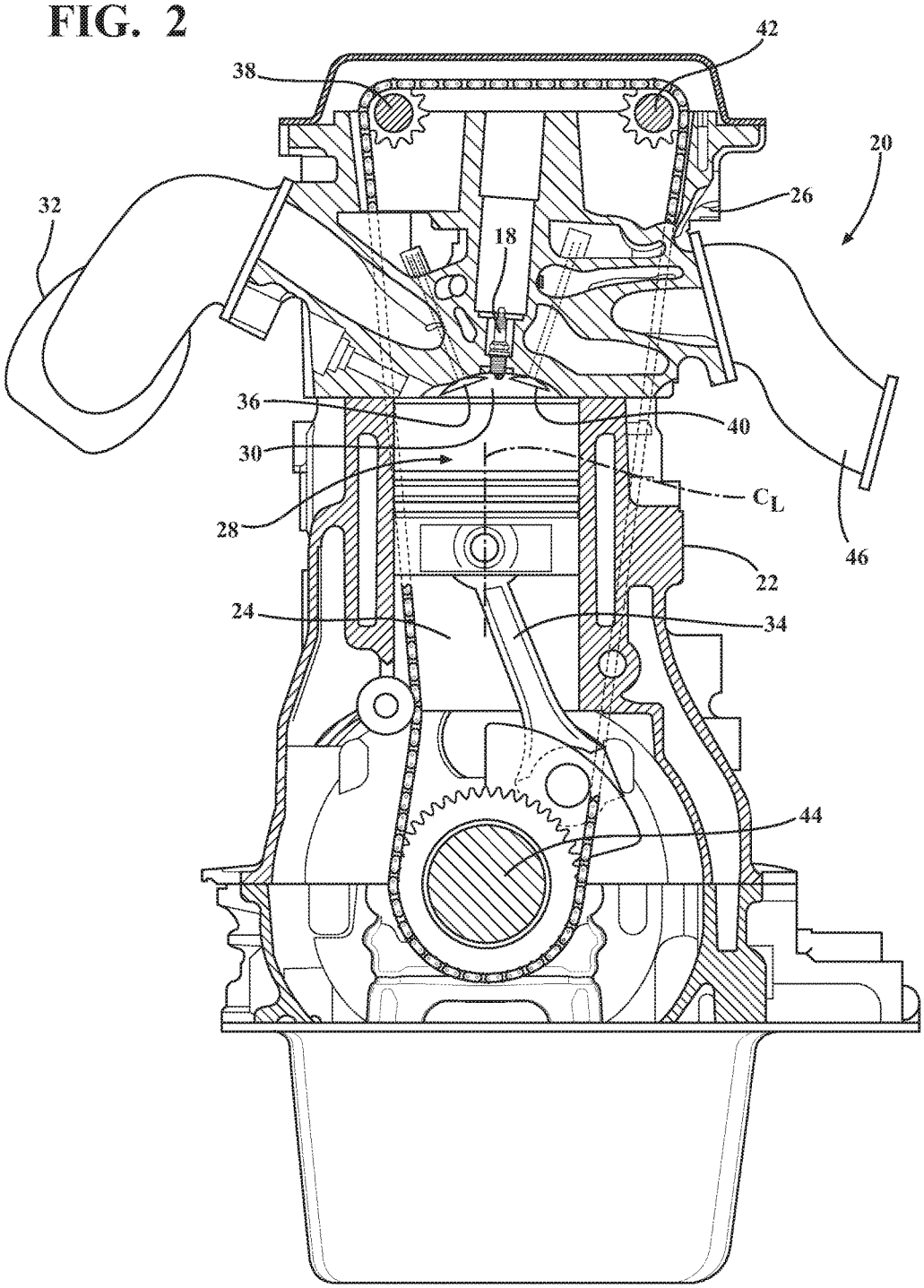
FIG. 2 is a schematic cross-sectional illustration of the engine shown in FIG. 1, the engine having a primary reciprocating piston for combustion and a secondary piston inside a combustion chamber for varying the engine's compression ratio.

As shown in FIG. 1, the powertrain 12 includes a transmission assembly 18 operatively connected to an internal combustion engine 20, wherein the engine generates output torque T and the transmission transfers the engine torque to the driven wheels 14. The internal combustion engine 20 can be configured as a spark- or compression-ignition type, as understood in the art. As shown in FIG. 2, the engine 20 includes an engine block 22. The engine block defines cylinders 24, each arranged along a respective cylinder centerline $C_L$. A cylinder head 26 is mounted, such as fastened, to the engine block 22. In the alternative, the cylinder head 26 may be integrated into or cast together with the engine block 22 (not shown). The cylinder head 26 receives air and fuel as a pre-combustion charge to be used inside the cylinders 24 for subsequent combustion. As can be seen in FIG. 2, each cylinder 24 includes a respective power-generating or primary piston 28 configured to reciprocate therein. Additionally, combustion chambers 30 are formed within the cylinders 24 between the bottom surface of the cylinder head 26 and the tops of the pistons 28. Accordingly, the cylinder head 26 defines at least a part of the combustion chambers 30.

As understood by those skilled in the art, a flow of air from the ambient is directed through an intake manifold 32 to each of the combustion chambers 30. Ambient air is combined either in the intake manifold 32 or inside the combustion chambers 30 with an appropriately metered amount of fuel to form a fuel-air mixture for subsequent combustion inside the subject combustion chamber. As also known by those skilled in the art, an intake air compressor device, such as a turbocharger or a supercharger (not shown), can be employed to increase pressure of the ambient air charge to enhance torque output of the engine 20. Although an in-line four-cylinder engine is shown in FIGS. 1-2, nothing precludes the present disclosure from being applied to an engine having a different number and/or arrangement of cylinders.

As shown on FIG. 2, the engine 20 also includes one or more intake valves 36 operatively connected to the cylinder head 26 and configured to control a supply of intake air to each cylinder 24 for combustion with fuel therein. An intake camshaft 38 can be employed to regulate opening and closing of the respective intake valve(s) 36 during operation of the engine 20. The engine 20 additionally includes one or more exhaust valves 40 operatively connected to the cylinder head 26 and configured to control removal of post-combustion gasses from each cylinder 24. An exhaust camshaft 42 can be employed to regulate opening and closing of the respective exhaust valves 40 during operation of the engine 20.

The engine 20 also includes a crankshaft 44 configured to rotate within the engine block 22 by an application of a combustion force to the primary piston 28. Specifically, and as understood by those skilled in the art, the crankshaft 44 is rotated by the primary pistons 28 via connecting rods 34 as a result of an appropriately proportioned of fuel and air being selectively admitted into the combustion chambers 30 via one or more intake valves 36, compressed by the primary pistons 28, and burned in the combustion chambers. After the air-fuel mixture is burned inside a specific combustion chamber 30, the reciprocating motion of a respective primary piston 28 serves to exhaust post-combustion gasses from the respective cylinder 24 via one or more exhaust valves 40.

The cylinder head 26 is also configured to exhaust post-combustion gasses from the combustion chambers 30, such as via an exhaust manifold 46. As shown in FIG. 2, the engine 20 can employ spark plugs 48, i.e., at least a part of each spark plug can be arranged inside a respective combustion chamber 30 and configured to ignite the mixture of air and fuel for initiating combustion thereof. Specifically, there can be plurality, for example two, spark plugs 48 employed by each respective combustion chamber 30 (as shown in FIG. 3). If the engine 20 is configured as a compression-ignition type, the cylinders 24 can be devoid of such spark plugs, since the combustion of the fuel-air mixture can be initiated solely via compression thereof.

As will be described below, the engine 20 is provided with a Variable Compression Ratio (VCR) and can also include Miller cycle capability. Such capability to vary the compression ratio of the engine 20 can be used to optimize the potential fuel efficiency gains of Miller cycle operation without the inherent spark limitations of a fixed VCR Miller cycle at high engine loads. Accordingly, the engine 20 can also employ mechanically or electromechanically operated phasers (not shown) for the camshafts 38 and 42 to optimize opening and closing events for the respective intake valve 36 and exhaust valve 40, particularly to enable operation of the engine using the Miller cycle.

In the Miller cycle, the intake valve(s) 36 are kept open longer than they would be in a traditional Otto or Diesel cycle. In effect, in the Miller cycle the compression stroke is split into two discrete cycles—the initial portion when the engine's intake valve is open and final portion when the intake valve is closed. As the primary piston 28 initially moves upwards toward the combustion chamber 30 in what is traditionally the compression stroke, the intake charge is partially expelled back out through the still-open intake valve(s) 36. Therefore, in the Miller cycle engine, the piston 28 begins to compress the fuel-air mixture only after the intake valve(s) 36 close, i.e., only during a part of the compression stroke.

While in the Otto and Diesel cycle the expansion ratio and the compression ratio are equal, the Miller cycle has a greater expansion ratio than compression ratio. The increased expansion ratio allows more work to be extracted from the combustion gases as the gases are expanded to nearly atmospheric pressure. Delaying the closing of the intake valve(s) 36 in the Miller cycle in effect shortens the compression stroke compared to the expansion stroke and allows the combustion gases to be expanded to atmospheric pressure, thereby potentially increasing the efficiency of the Miller cycle. As such, it is typically the Miller cycle's greater efficiency that fosters its use in internal combustion engines.

In spark-ignition internal combustion engines, at low engine speeds and loads, the use of the Miller cycle in spark-ignition internal combustion engines provides a significant fuel efficiency benefit, particularly when combined with an elevated compression ratio, such as above 12:1, to take advantage of the thermal efficiency gains. At high engine speeds and loads, however, Miller cycle enabled spark-ignition engines with such elevated compression ratio become spark limited to the degree that the engine's maximum power potential is significantly reduced. A Miller cycle enabled engine with VCR is capable of overcoming such power limitations. The VCR enables operation of the spark-ignition engine using an elevated compression ratio during low engine speeds and loads to maximize thermal efficiency, while a reduced compression ratio can be used at high engine speeds and loads to achieve increased power and acceptable fuel efficiency. In compression-ignition engines, Miller cycle can help reduce emissions of Nitrogen Oxides (NOx) and increase engine efficiency, especially at higher engine loads.

Figure 5:
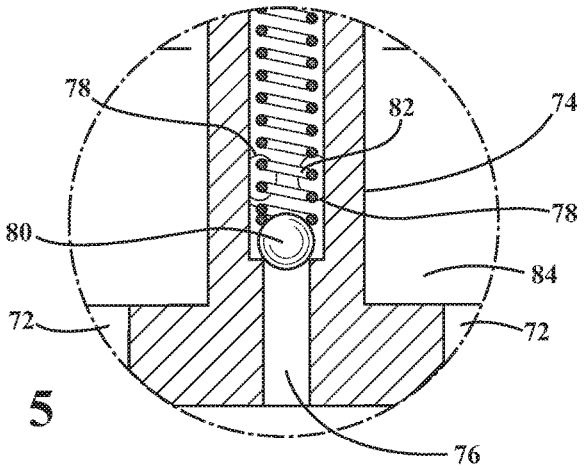
FIG. 5 is a schematic cross-sectional up-close illustration of a specific section of the secondary piston shown in FIG. 4.

As shown in FIGS. 3-5, a secondary piston 50 is mounted in the cylinder head 26, movably with respect to the particular combustion chamber 30. A mechanism 52 is configured to shift the secondary piston 50 within the cylinder head 26 and thereby vary a volume of the combustion chamber 30 and generate VCR in the engine 20. The mechanism 52 can include an electro-mechanical actuator 54 configured to generate a linear motion of the secondary piston 50. The secondary piston 50 can be arranged along the cylinder centerline $C_L$ of the respective cylinder 24, such that the linear motion imparted by the mechanism 52 to the secondary piston can also extend along the centerline. In certain cases, however, the secondary piston 50 may need to be shifted off the centerline $C_L$, such as to make room for enlarged intake valves 36 or for a plurality of spark plugs 48 to be located proximate one another to minimize flame quenching and optimize sweeping of the combustion chamber 30. Operation of the mechanism 52 can be regulated by an electronic controller 53 arranged in the vehicle 10 and programmed with appropriate engine 20 operating parameters and data points, such as in the form of a look-up table. The controller 53 can be a powertrain controller configured to regulate various modes of operation of the powertrain 12, or a stand-alone engine controller for the engine 20.

Figure 6:
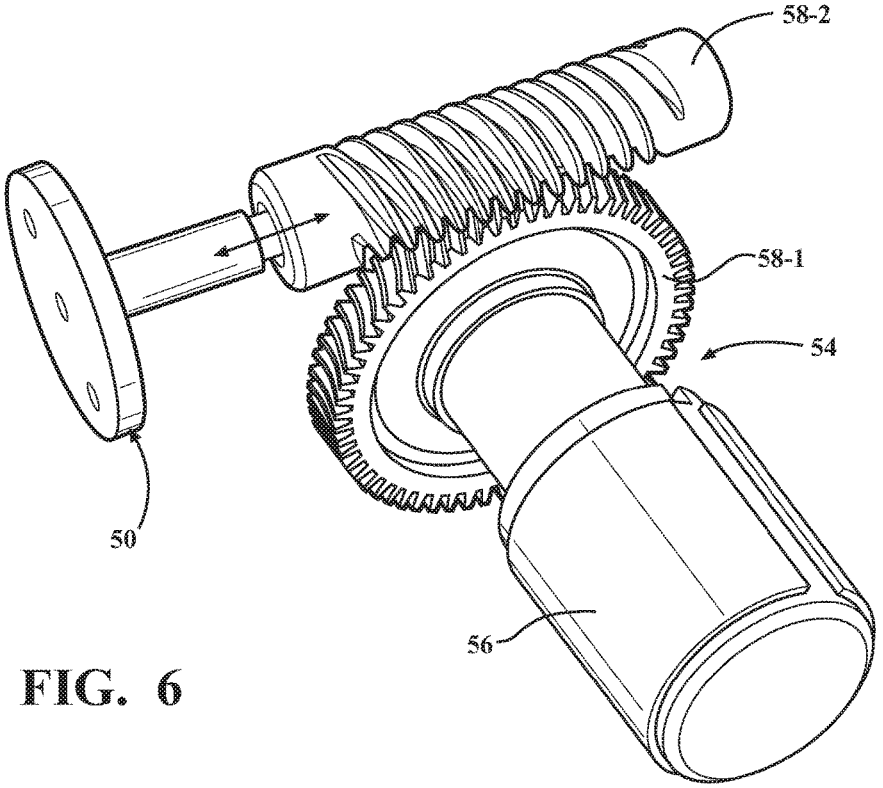
FIG. 6 is a schematic illustration of an embodiment of a mechanism employed to shift the secondary piston with respect to the combustion chamber.

As shown in FIG. 6, the electro-mechanical actuator 54 can include a stepper motor 56 operatively connected to a worm wheel 58-1 that meshes with a worm screw 58-2. The worm screw 58-2 is, in turn, connected to the secondary piston 50 for shifting thereof. In general, the stepper motor 56 is a brushless DC electric motor that divides the motor's full rotation into a number of equal steps. Specifically, the stepper motor 56 can be configured to convert a train of input pulses into a precisely defined increment in the position of the worm wheel 58-1 and thereby specific position of the secondary piston 50. Accordingly, each input pulse to the stepper motor 56 moves the worm wheel 58-1 through a fixed angle. The position of the stepper motor 56 can be commanded to move and hold at one of these steps via an open-loop control, i.e., without requiring a feedback signal.

Figure 7:
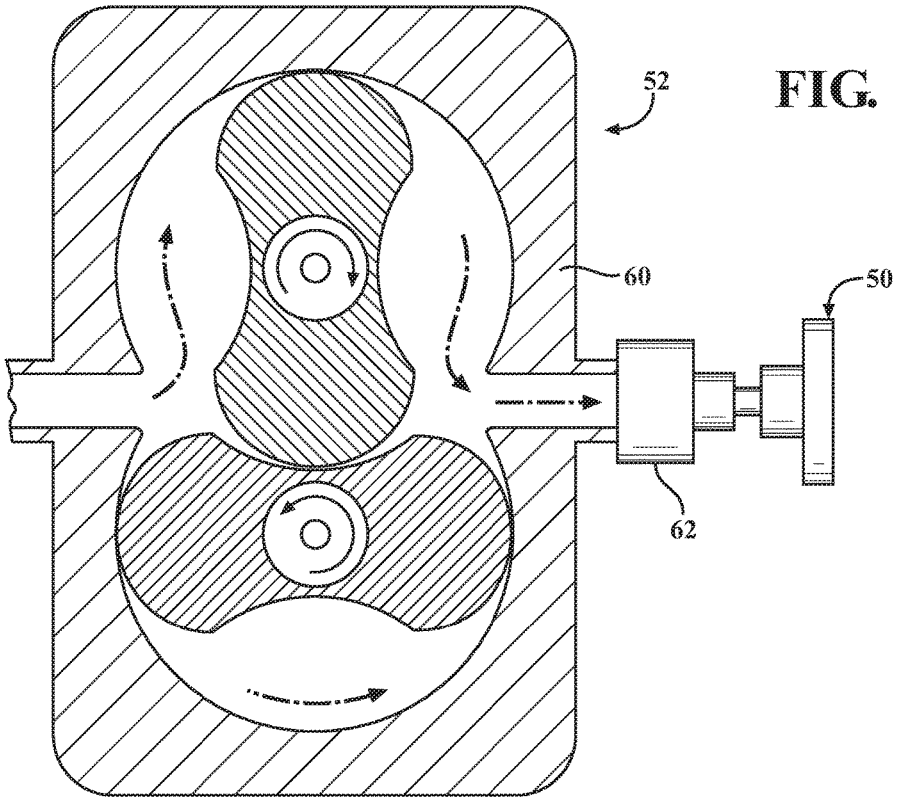
FIG. 7 is a schematic illustration of another embodiment of the mechanism employed to shift the secondary piston with respect to the combustion chamber.
Figure 8:
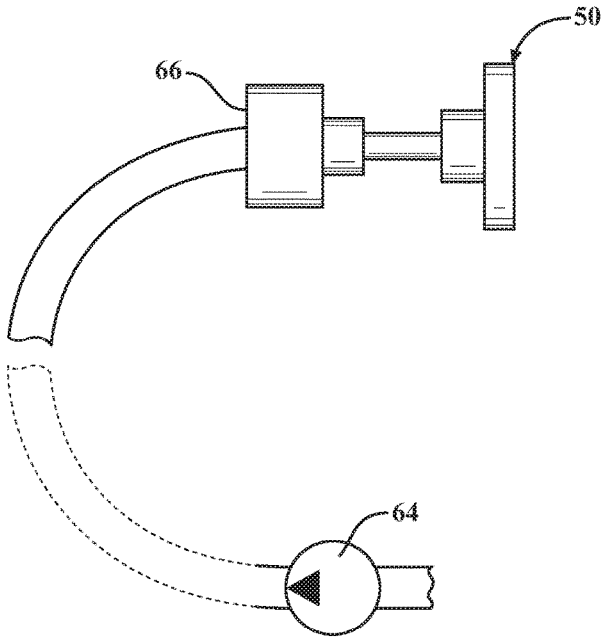
FIG. 8 is a schematic illustration of yet another embodiment of the mechanism employed to shift the secondary piston with respect to the combustion chamber.

As shown in FIG. 1, the vehicle 10 can also include a vacuum pump 60, which can be arranged on the engine 20 or elsewhere on the vehicle. Consequently, in another embodiment, the mechanism 52 can include a pneumatic actuator 62 driven by the vacuum pump 60. The vacuum pump 60 can be configured, for example, as a Roots type (shown in FIG. 7) or a spiral type pump that uses two interleaving scrolls with involute vane geometry (not shown). The vehicle 10 can additionally include a fluid pump 64 configured to pressurize and circulate engine oil. The fluid pump 64 can be part of the engine 20 or can be mounted external thereto. In such a case, a separate embodiment of the mechanism 52 (shown in FIG. 8) can include a hydraulic actuator 66 driven by the oil pressurized via the fluid pump 60. Any of the above embodiments of the mechanism 52 can be regulated by the controller 53 to shift the secondary piston 50 within the cylinder head 26 and generate VCR in the engine 20.

As shown in FIG. 4, the cylinder head 26 can define a cavity 68. The secondary piston 50 is configured to shift inside the cavity 68. The secondary piston 50 includes a secondary piston body 70 defined by an outer diameter D1, while the cavity 68 can be defined by an internal diameter D2 (shown in FIG. 3). A specific difference between diameters D1 and D2 can be selected to define sufficient clearance between the secondary piston body 70 and the cavity 68 to permit unimpeded sliding motion of the secondary piston 50, while controlling linearity of the secondary piston's motion. Additionally, the difference between diameters D1 and D2 can be specified to control gas leakage from the combustion chamber 30 past the secondary piston body 70.

By shifting inside the cavity 68, the secondary piston body 70 varies the compression ratio of the engine 20 via selectively expanding and contracting the volume of the cavity open to the combustion chamber 30. FIG. 4 illustrates a section of the combustion chamber 30 as viewed along section line 4-4 shown in FIG. 3. As shown in FIG. 4, the secondary piston body 70 has a first surface 70-1 facing the respective primary piston 28 (shown in FIG. 2) and an opposing, i.e., arranged on the opposite side of the first surface, second surface 70-2. The secondary piston body 70 can define one or more vent orifices 72. Each of the vent orifices 72 is configured to provide pressure equalization between the first surface 70-1 and the second surface 70-2 of the piston body 70. A secondary piston shaft 74 is fixed to the second surface 70-2 of the secondary piston body 70 and is operatively connected to the mechanism 52.

FIG. 5 illustrates an enlarged view of a detail 5 shown in FIG. 4. As shown in FIGS. 4 and 5, the secondary piston 50 also defines a gas passage 76 extending from the first surface 70-1 of the piston body into the shaft 74. The gas passage 76 is in fluid communication with one or more blow-off orifices 78, wherein each of the blow-off orifices can be arranged substantially perpendicular to the gas passage. The piston shaft can also include a check-valve 80 arranged inside the gas passage 74. As shown, the check-valve 80 is preloaded by a spring 82 and is configured to relieve gas pressure from inside the combustion chamber 30 through the blow-off orifice(s) 76 above a predetermined combustion pressure value into a pressure equalization chamber 84.

As noted above, typically, high engine load at low engine speed results in elevated pressure inside the combustion chambers 30, thereby increasing the likelihood of knock or auto ignition due to uncontrolled combustion. Therefore, at lower engine speeds, increasing the volume of the combustion chamber 30, by shifting the secondary piston 50 away from the primary piston 28, reduces the pre-combustion pressures inside the particular cylinder 24, and reduces the likelihood of knock. On the other hand, at higher engine speeds, reducing the volume of the combustion chamber 30 by shifting the secondary piston 50 toward the primary piston 28 increases the compression ratio of the particular cylinder 24 and permits the cylinder to generate higher peak cylinder pressures and develop increased power.

As a result of the secondary piston 50 being shifted inside the combustion chamber 30 by the mechanism 52, the combustion pressures inside the combustion chamber 30 can be effectively managed via VCR during certain engine operating modes. Overall, the secondary piston 50 operated by the mechanism 52 can be controlled to generate increased VCR in combination with an increased expansion ratio of the Miller cycle operation for enhanced fuel efficiency of the engine 20 at lower engine speeds. Additionally, the secondary piston 50 can be operated by the mechanism 52 to reduce the VCR at higher engine speeds and thereby enhance the engine's power output.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A variable compression ratio (VCR) internal combustion engine comprising:

an engine block defining a cylinder having a cylinder centerline;

a cylinder head mounted to the engine block and defining at least a part of a combustion chamber;

a reciprocating primary piston arranged inside the cylinder and configured to compress a mixture of air and fuel;

a crankshaft arranged in the engine block and rotated by an application of a combustion force to the primary piston;

a secondary piston mounted in the cylinder head, movably with respect to the combustion chamber; and a mechanism configured to shift the secondary piston in the cylinder head and thereby vary a volume of the combustion chamber and the compression ratio of the engine, wherein:

the mechanism is configured to generate a linear motion of the secondary piston along the cylinder centerline;

the secondary piston includes a secondary piston body having a first surface facing the primary piston, an opposing second surface, and a secondary piston shaft fixed to the second surface of the secondary piston body, and wherein the secondary piston shaft is operatively connected to the mechanism;

the secondary piston defines a gas passage extending from the first surface of the secondary piston body into the shaft;

the gas passage is in fluid communication with a blow-off orifice;

the secondary piston shaft includes a check-valve arranged inside the gas passage; and the check-valve is configured to relieve pressure from inside the combustion chamber into the blow-off orifice above a predetermined combustion pressure value.

2. The engine of claim 1, wherein mechanism includes an electro-mechanical actuator having a stepper motor operatively connected to a worm wheel in mesh with a worm screw.

3. The engine of claim 1, further comprising a fluid pump configured to pressurize engine oil, wherein the mechanism includes a hydraulic actuator driven by the oil pressurized by the fluid pump.

4. The engine of claim 1, further comprising a vacuum pump, wherein the mechanism includes a pneumatic actuator driven by the vacuum pump.

5. The engine of claim 1, wherein the cylinder head defines a cavity and the secondary piston is configured to shift inside the cavity.

6. The engine of claim 1, further comprising a plurality of spark plugs arranged inside the combustion chamber and configured to ignite the mixture of air and fuel for initiating combustion thereof.

7. A vehicle comprising:

a road wheel; and a variable compression ratio (VCR) internal combustion engine configured to generate torque for driving the road wheel, the engine having:

an engine block defining a cylinder having a cylinder centerline;

a cylinder head mounted to the engine block and defining at least a part of a combustion chamber;

a reciprocating primary piston arranged inside the cylinder and configured to compress a mixture of air and fuel;

a crankshaft arranged in the engine block and rotated by an application of a combustion force to the primary piston;

a secondary piston mounted in the cylinder head, movably with respect to the combustion chamber; and a mechanism configured to shift the secondary piston in the cylinder head and thereby vary a volume of the combustion chamber and a compression ratio of the engine;

wherein:

the mechanism is configured to generate a linear motion of the secondary piston along the cylinder centerline;

the secondary piston includes a secondary piston body having a first surface facing the primary piston, an opposing second surface, and a secondary piston shaft fixed to the second surface of the secondary piston body, and wherein the secondary piston shaft is operatively connected to the mechanism;

the secondary piston defines a gas passage extending from the first surface of the secondary piston body into the shaft;

the gas passage is in fluid communication with a blow-off orifice;

the secondary piston shaft includes a check-valve arranged inside the gas passage; and the check-valve is configured to relieve pressure from inside the combustion chamber into the blow-off orifice above a predetermined combustion pressure value.

8. The vehicle of claim 7, wherein mechanism includes an electro-mechanical actuator having a stepper motor operatively connected to a worm wheel in mesh with a worm screw.

9. The vehicle of claim 7, further comprising a fluid pump configured to pressurize engine oil, wherein the mechanism includes a hydraulic actuator driven by the oil pressurized by the fluid pump.

10. The vehicle of claim 7, further comprising a vacuum pump, wherein the mechanism includes a pneumatic actuator driven by the vacuum pump.

11. The vehicle of claim 7, wherein the cylinder head defines a cavity and the secondary piston is configured to shift inside the cavity.

12. The vehicle of claim 7, wherein the secondary piston body defines a vent orifice configured to provide pressure equalization between the first surface and the second surface of the secondary piston body.

13. The vehicle of claim 7, wherein the engine additionally includes a plurality of spark plugs arranged inside the combustion chamber and configured to ignite the mixture of air and fuel for initiating combustion thereof.

* * * * *